US005708916A

United States Patent [19]

Mestha

[11] Patent Number: 5,708,916

[45] Date of Patent: Jan. 13, 1998

[54] DEVELOPED MASS PER UNIT AREA CONTROLLER WITHOUT USING ELECTROSTATIC MEASUREMENTS

[75] Inventor: Lingappa K. Mestha, Fairport, N.Y.

[73] Assignee: Xerox Corporation, Stamford, Conn.

[21] Appl. No.: 757,057

[22] Filed: Nov. 26, 1996

[51] Int. Cl.[6] ..... G03G 15/00

[52] U.S. Cl. ..... 399/49; 399/46

[58] Field of Search ..... 399/49, 50, 51, 399/53, 55, 72, 15, 46

[56] References Cited

U.S. PATENT DOCUMENTS

| | | | |
|---|---|---|---|
| 4,341,461 | 7/1982 | Fantozzi | 399/49 |
| 4,456,370 | 6/1984 | Hayes, Jr. | 399/50 |
| 4,563,086 | 1/1986 | Knapp et al. | 399/49 |
| 5,119,132 | 6/1992 | Butler | 399/49 |
| 5,155,530 | 10/1992 | Larson et al. | 399/55 |
| 5,243,383 | 9/1993 | Parisi | 399/50 |
| 5,436,705 | 7/1995 | Raj | 399/59 |
| 5,576,811 | 11/1996 | Kobayashi et al. | 399/15 X |

*Primary Examiner*—Arthur T. Grimley
*Assistant Examiner*—Sophia S. Chen
*Attorney, Agent, or Firm*—Ronald F. Chapuran

[57] ABSTRACT

An electrostatographic printing machine having an imaging system for projecting and developing images on an imaging member. A process control loop includes a sensor to measure developed mass per unit area on at least three test patches on the imaging member including high area coverage, low area coverage, and mid tone coverage. A comparator responds to the sensor measurements and to developed mass per unit area setpoints to provide error signals. A control unit responds to the error signals to adjust projecting, developing, and imaging member subsystems.

19 Claims, 3 Drawing Sheets

DEVELOPED MASS PER UNIT AREA CONTROLLER WITHOUT USING ELECTROSTATIC MEASUREMENTS

This invention relates generally to an electrostatographic printing machine and, more particularly, concerns a process to adjust a xerographic control, in particular, to adjust charging, beam power, and developer actuators in response to the sensing of developed mass per unit area (DMA) on an imaging member The basic reprographic process used in an electrostatographic printing machine generally involves an initial step of charging a photoconductive member to a substantially uniform potential. The charged surface of the photoconductive member is thereafter exposed to a light image of an original document to selectively dissipate the charge thereon in selected areas irradiated by the light image. This procedure records an electrostatic latent image on the photoconductive member corresponding to the informational areas contained within the original document being reproduced. The latent image is then developed by bringing a developer material including toner particles adhering triboelectrically to carrier granules into contact with the latent image. The toner particles are attracted away from the carrier granules to the latent image, forming a toner image on the photoconductive member which is subsequently transferred to a copy sheet. The copy sheet having the toner image thereon is then advanced to a fusing station for permanently affixing the toner image to the copy sheet in image configuration.

In electrostatographic machines using a drum-type or an endless belt-type photoconductive member, the photosensitive surface thereof can contain more than one image at one time as it moves through various processing stations. The portions of the photosensitive surface containing the projected images, so-called "image areas", are usually separated by a segment of the photosensitive surface called the inter-document space. After charging the photosensitive surface to a suitable charge level, the inter-document space segment of the photosensitive surface is generally discharged by a suitable lamp to avoid attracting toner particles at the development stations. Various areas on the photosensitive surface, therefore, will be charged to different voltage levels. For example, there will be the high voltage level of the initial charge on the photosensitive surface, a selectively discharged image area of the photosensitive surface, and a fully discharged portion of the photosensitive surface between the image areas.

The approach utilized for multicolor electrostatographic printing is substantially identical to the process described above. However, rather than forming a single latent image on the photoconductive surface in order to reproduce an original document, as in the case of black and white printing, multiple latent images corresponding to color separations are sequentially recorded on the photoconductive surface. Each single color electrostatic latent image is developed with toner of a color complimentary thereto and the process is repeated for differently colored images with the respective toner of complimentary color. Thereafter, each single color toner image can be transferred to the copy sheet in superimposed registration with the prior toner image, creating a multi-layered toner image on the copy sheet. Finally, this multi-layered toner image is permanently affixed to the copy sheet in substantially conventional manner to form a finished color copy.

As described, the surface of the photoconductive member must be charged by a suitable device prior to exposing the photoconductive member to a light image. This operation is typically performed by a corona charging device. One type of corona charging device comprises a current carrying electrode enclosed by a shield on three sides and a wire grid or control screen positioned thereover, and spaced apart from the open side of the shield. Biasing potentials are applied to both the electrode and the wire grid to create electrostatic fields between the charged electrode and the shield, between the charged electrode and the wire grid, and between the charged electrode and the (grounded) photoconductive member. These fields repel electrons from the electrode and the shield resulting in an electrical charge at the surface of the photoconductive member roughly equivalent to the grid voltage. The wire grid is located between the electrode and the photoconductive member for controlling the charge strength and charge uniformity on the photoconductive member as caused by the aforementioned fields.

Control of the field strength and the uniformity of the charge on the photoconductive member is very important because consistently high quality reproductions are best produced when a uniform charge having a predetermined magnitude is obtained on the photoconductive member. If the photoconductive member is not charged to a sufficient level, the electrostatic latent image obtained upon exposure will be relatively weak and the resulting deposition of development material will be correspondingly decreased. As a result, the copy produced by an undercharged photoconductor will be faded. If, however, the photoconductive member is overcharged, too much developer material will be deposited on the photoconductive member. The copy produced by an overcharged photoconductor will have a gray or dark background instead of the white background of the copy paper. In addition, areas intended to be gray will be black and tone reproduction will be poor. Moreover, if the photoconductive member is excessively overcharged, the photoconductive member can become permanently damaged.

A useful tool for measuring voltage levels on the photosensitive surface is an electrostatic voltmeter (ESV) or electrometer. The electrometer is generally rigidly secured to the reproduction machine adjacent the moving photosensitive surface and measures the voltage level of the photosensitive surface as it traverses an ESV probe. The surface voltage is a measure of the density of the charge on the photoreceptor, which is related to the quality of the print output. In order to achieve high quality printing, the surface potential on the photoreceptor at the developing zone should be within a precise range.

Various systems have been designed and implemented for controlling charging processes within a printing machine. For example, U.S. Pat. No. 5,243,383 discloses a charge control system that measures first and second surface voltage potentials to determine a dark decay rate model representative of voltage decay with respect to time. The dark decay rate model is used to determine the voltage at any point on the imaging surface corresponding to a given charge voltage. This information provides a predictive model to determine the charge voltage required to produce a target surface voltage potential at a selected point on the imaging surface.

U.S. Pat. No. 5,243,383 discloses a charge control system that uses three parameters to determine a substrate charging voltage, a development station bias voltage, and a laser power for discharging the substrate. The parameters are various difference and ratio voltages.

U.S. Pat. No. 5,436,705 discloses an adaptive process control that uses responses from a toner area coverage sensor and a toner concentration sensor to generate control signals. An identifer also responds to the control and sensor signals to modify target images to compensate for material aging or environmental changes.

In addition, in copying or printing systems, such as a xerographic copier, laser printer, or ink-jet printer, a common technique for monitoring the quality of prints is to artificially create a "test patch" of a predetermined desired density. The actual density of the printing material (toner or ink) in the test patch can then be optically measured by a suitable sensor to determine the effectiveness of the printing process in placing this printing material on the print sheet.

In the case of xerographic devices, such as a laser printer, the surface that is typically of most interest in determining the density of printing material thereon is the charge-retentive surface or photoreceptor, on which the electrostatic latent image is formed and subsequently, developed by causing toner particles to adhere to areas thereof that are charged in a particular way. In such a case, the optical device for determining the density of toner on the test patch, which is often referred to as a "densitometer", is disposed along the path of the photoreceptor, directly downstream of the development of the development unit. There is typically a routine within the operating system of the printer to periodically create test patches of a desired density at predetermined locations on the photoreceptor by deliberately causing the exposure system thereof to charge or discharge as necessary the surface at the location to a predetermined extent.

The test patch is then moved past the developer unit and the toner particles within the developer unit are caused to adhere to the test patch electrostatically. The denser the toner on the test patch, the darker the test patch will appear in optical testing. The developed test patch is moved past a densitometer disposed along the path of the photoreceptor, and the light absorption of the test patch is tested; the more light that is absorbed by the test patch, the denser the toner on the test patch. The sensor readings are then used to make suitable adjustments to the system such as changing developer bias to maintain consistent quality.

Test patches are used to measure the deposition of toner on paper to measure and control the tone reproduction curve (TRC). Typically each patch is about an inch square that is printed as a uniform solid half tone or background area. This practice enables the sensor to read one value on the tone reproduction curve for each test patch.

In accordance with the present invention, it has been discovered that it is possible to precisely control a machine's electrostatic and development subsystems without the use of an ESV sensor, but merely using an IRD or developed mass per unit volume patch sensor. In particular, in some machines, electrostatic parameters are controlled by processing the error between setpoints and photoreceptor voltages (both exposed and unexposed portions of the photoreceptor) and then varying charging and exposure parameters such as grid voltage on the charging system and beam power on the exposure system. This is one kind of control loop and the gains in these loops are tuned such that the photoreceptor voltages will converge to setpoints in some finite prints. Another type of control loop is from DMA measurements from optical sensors which are compared to target DMAs. The error is processed through a controller to generate setpoints. The DMA control loop gains are tuned such that the DMA control loop is enabled at every x number of prints.

However, in this architecture, it is necessary to use both ESV and IRD sensors for the measurement of electrostatic and DMA parameters. ESV sensors are expensive and elimination of such a sensor can result in significant cost saving. It would be desirable, therefore, to be able to eliminate ESV sensors for the measurement of photoreceptor voltages and rely only on DMA sensor measurements to control electrostatic parameters.

It is an object of the present invention, therefore, to provide a xerographic control system that relies only on DMA sensor measurements to control electrostatic parameters and does not require any system identification algorithms to estimate on line the electrostatic parameters. It is another object of the present invention to provide an architecture having a simple multiple-input multiple-output linear integral controller for a xerographic control system that uses only DMA sensor measurements to control electrostatic parameters. Other advantages as well as alternatives, modifications, and variations of the present invention will be apparent as the following description proceeds and the features characterizing the invention will be pointed out with particularity in the claims annexed to and forming part of this specification. It is intended to embrace all such alternatives, modifications and variations that fall within the spirit and scope of the appended claims.

SUMMARY OF THE INVENTION

The present invention relates to an electrostatographic printing machine having an imaging system for projecting and developing images on an imaging member. A process control loop includes a sensor to measure developed mass per unit area on at least three test patches on the imaging member including high area coverage, low area coverage, and mid tone coverage. A comparator responds to the sensor measurements and to developed mass per unit area setpoints to provide error signals. A control unit responds to the error signals to adjust projecting, developing, and imaging member subsystems.

Other features of the present invention will become apparent as the following description proceeds and upon reference to the drawings, in which.

Figure 1:
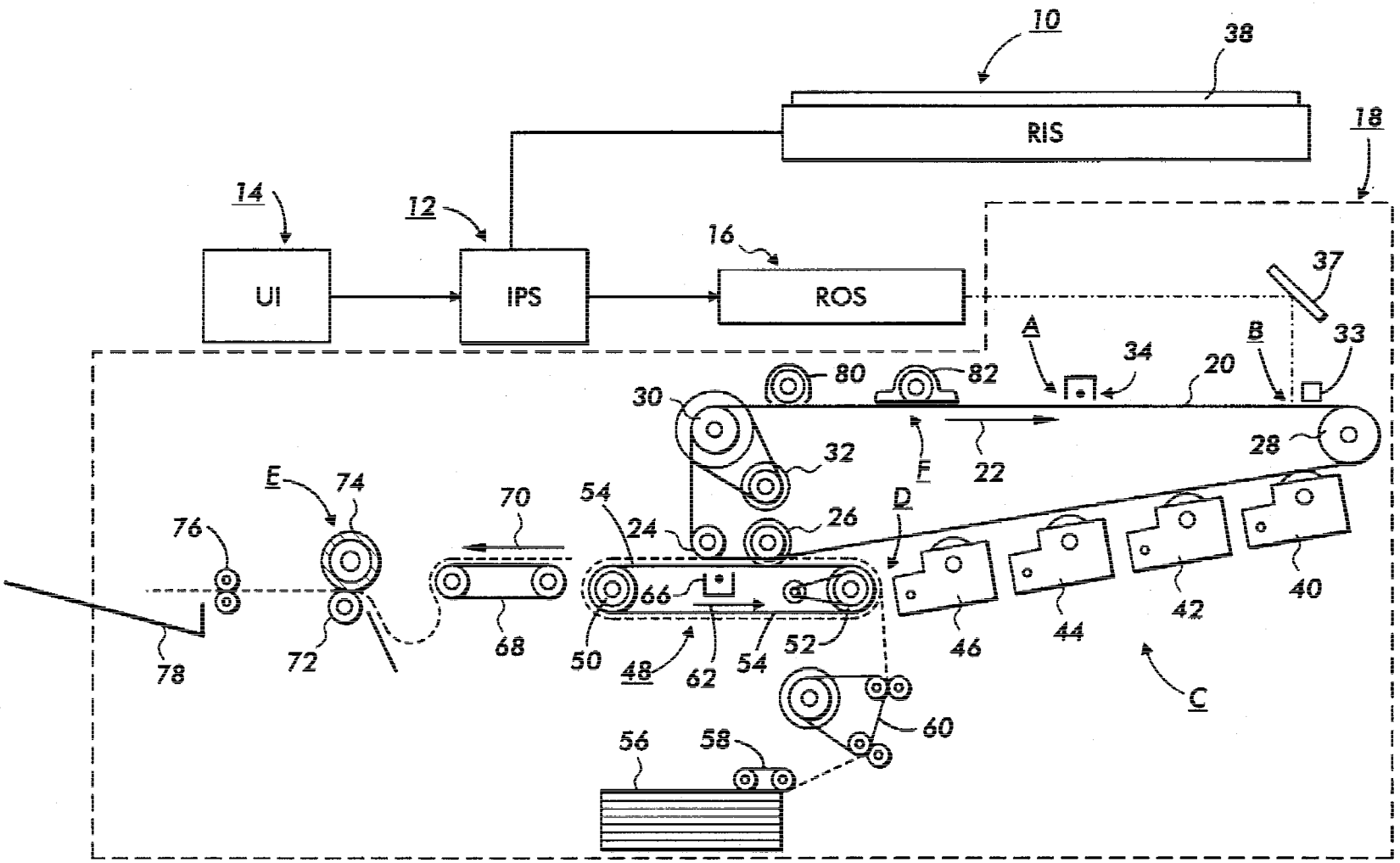
FIG. 1 is a schematic elevational view of an exemplary multi-color electrophotographic printing machine which can be utilized in the practice of the present invention.

For a general understanding of the features of the present invention, reference is made to the drawings wherein like references have been used throughout to designate identical elements. A schematic elevational view showing an exemplary electrophotographic printing machine incorporating the features of the present invention therein is shown in FIG. 1. It will become evident from the following discussion that the present invention is equally well-suited for use in a wide variety of printing systems including ionographic printing machines and discharge area development systems, as well as other more general non-printing systems providing multiple or variable outputs such that the invention is not necessarily limited in its application to the particular system shown herein.

Turning initially to FIG. 1, before describing the particular features of the present invention in detail, an exemplary electrophotographic copying apparatus will be described. The exemplary electrophotographic system may be a multicolor copier, as for example, the recently introduced Xerox Corporation "5775" copier. To initiate the copying process, a multicolor original document 38 is positioned on a raster input scanner (RIS), indicated generally by the reference numeral 10. The RIS 10 contains document illumination lamps, optics, a mechanical scanning drive, and a charge coupled device (CCD array) for capturing the entire image from original document 38. The RIS 10 converts the image to a series of raster scan lines and measures a set of primary color densities, i.e. red, green and blue densities, at each point of the original document. This information is transmitted as an electrical signal to an image processing system (IPS), indicated generally by the reference numeral 12, which converts the set of red, green and blue density signals to a set of colorimetric coordinates. The IPS contains control electronics for preparing and managing the image data flow to a raster output scanner (ROS), indicated generally by the reference numeral 16.

A user interface (UI), indicated generally by the reference numeral 14, is provided for communicating with IPS 12. UI 14 enables an operator to control the various operator adjustable functions whereby the operator actuates the appropriate input keys of UI 14 to adjust the parameters of the copy. UI 14 may be a touch screen, or any other suitable device for providing an operator interface with the system. The output signal from UI 14 is transmitted to IPS 12 which then transmits signals corresponding to the desired image to ROS 16.

ROS 16 includes a laser with rotating polygon mirror blocks. The ROS 16 illuminates, via mirror 37, a charged portion of a photoconductive belt 20 of a printer or marking engine, indicated generally by the reference numeral 18. Preferably, a multi-facet polygon mirror is used to illuminate the photoreceptor belt 20 at a rate of about 400 pixels per inch. The ROS 16 exposes the photoconductive belt 20 to record a set of three subtractive primary latent images thereon corresponding to the signals transmitted from IPS 12. One latent image is to be developed with cyan developer material, another latent image is to be developed with magenta developer material, and the third latent image is to be developed with yellow developer material. These developed images are subsequently transferred to a copy sheet in superimposed registration with one another to form a multicolored image on the copy sheet which is then fused thereto to form a color copy. This process will be discussed in greater detail hereinbelow.

With continued reference to FIG. 1, marking engine 18 is an electrophotographic printing machine comprising photoconductive belt 20 which is entrained about transfer rollers 24 and 26, tensioning roller 28, and drive roller 30. Drive roller 30 is rotated by a motor or other suitable mechanism coupled to the drive roller 30 by suitable means such as a belt drive 32. As roller 30 rotates, it advances photoconductive belt 20 in the direction of arrow 22 to sequentially advance successive portions of the photoconductive belt 20 through the various processing stations disposed about the path of movement thereof.

Photoconductive belt 20 is preferably made from a polychromatic photoconductive material comprising an anti-curl layer, a supporting substrate layer and an electrophotographic imaging single layer or multi-layers. The imaging layer may contain homogeneous, heterogeneous, inorganic or organic compositions. Preferably, finely divided particles of a photoconductive inorganic compound are dispersed in an electrically insulating organic resin binder. Typical photoconductive particles include metal free phthalocyanine, such as copper phthalocyanine, quinacridones, 2,4-diaminotriazines and polynuclear aromatic quinines. Typical organic resinous binders include polycarbonates, acrylate polymers, vinyl polymers, cellulose polymers, polyesters, polysiloxanes, polyamides, polyurethanes, epoxies, and the like.

Initially, a portion of photoconductive belt 20 passes through a charging station, indicated generally by the reference letter A. At charging station A, a corona generating device 34 or other charging device generates a charge voltage to charge photoconductive belt 20 to a relatively high, substantially uniform voltage potential. The corona generator 34 comprises a corona generating electrode, a shield partially enclosing the electrode, and a grid disposed between the belt 20 and the unenclosed portion of the electrode. The electrode charges the photoconductive surface of the belt 20 via corona discharge. The voltage potential applied to the photoconductive surface of the belt 20 is varied by controlling the voltage potential of the Wire grid.

Next, the charged photoconductive surface is rotated to an exposure station, indicated generally by the reference letter B. Exposure station B receives a modulated light beam corresponding to information derived by RIS 10 having a multicolored original document 38 positioned thereat. The modulated light beam impinges on the surface of photoconductive belt 20, selectively illuminating the charged surface of photoconductive belt 20 to form an electrostatic latent image thereon. The photoconductive belt 20 is exposed three times to record three latent images representing each color.

After the electrostatic latent images have been recorded on photoconductive belt 20, the belt is advanced toward a development station, indicated generally by the reference letter C. However, before reaching the development station C, the photoconductive belt 20 passes subjacent to a voltage monitor, preferably an electrostatic voltmeter 33, for measurement of the voltage potential at the surface of the photoconductive belt 20. The electrostatic voltmeter 33 can be any suitable type known in the art wherein the charge on the photoconductive surface of the belt 20 is sensed, such as disclosed in U.S. Pat. Nos. 3,870,968; 4,205,257; or 4,853,639, the contents of which are incorporated by reference herein.

A typical electrostatic voltmeter is controlled by a switching arrangement which provides the measuring condition in which charge is induced on a probe electrode corresponding to the sensed voltage level of the belt 20. The induced charge is proportional to the sum of the internal capacitance of the probe and its associated circuitry, relative to the probe-to-measured surface capacitance. A DC measurement circuit is combined with the electrostatic voltmeter circuit for providing an output which can be read by a conventional test meter or input to a control circuit, as for example, the control circuit of the present invention. The voltage potential measurement of the photoconductive belt 20 is utilized to determine specific parameters for maintaining a predetermined potential on the photoreceptor surface, as will be understood with reference to the specific subject matter of the present invention, explained in detail hereinbelow.

The development station C includes four individual developer units indicated by reference numerals 40, 42, 44 and 46. The developer units are of a type generally referred to in the art as "magnetic brush development units". Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive surface.

Developer units 40, 42, and 44, respectively, apply toner particles of a specific color corresponding to the compliment of the specific color separated electrostatic latent image recorded on the photoconductive surface. Each of the toner particle colors is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from a black and white original document.

In FIG. 1, developer unit 40 is shown in the operative position with developer units 42, 44 and 46 being in the non-operative position. During development of each electrostatic latent image, only one developer unit is in the operative position, while the remaining developer units are in the non-operative position. Each of the developer units is moved into and out of an operative position. In the operative position, the magnetic brush is positioned substantially adjacent the photoconductive belt, while in the non-operative position, the magnetic brush is spaced therefrom. Thus, each electrostatic latent image or panel is developed with toner particles of the appropriate color without commingling.

After development, the toner image is moved to a transfer station, indicated generally by the reference letter D. Transfer station D includes a transfer zone, defining the position at which the toner image is transferred to a sheet of support material, which may be a sheet of plain paper or any other suitable support substrate. A sheet transport apparatus, indicated generally by the reference numeral 48, moves the sheet into contact with photoconductive belt 20. Sheet transport 48 has a belt 54 entrained about a pair of substantially cylindrical rollers 50 and 52. A friction retard feeder 58 advances the uppermost sheet from stack 56 onto a pre-transfer transport 60 for advancing a sheet to sheet transport 48 in synchronism with the movement thereof so that the leading edge of the sheet arrives at a preselected position, i.e. a loading zone. The sheet is received by the sheet transport 48 for movement therewith in a recirculating path. As belt 54 of transport 48 moves in the direction of arrow 62, the sheet is moved into contact with the photoconductive belt 20, in synchronism with the toner image developed thereon.

In transfer zone 64, a corona generating device 66 sprays ions onto the backside of the sheet so as to charge the sheet to the proper magnitude and polarity for attracting the toner image from photoconductive belt 20 thereto. The sheet remains secured to the sheet gripper so as to move in a recirculating path for three cycles. In this manner, three different color toner images are transferred to the sheet in superimposed registration with one another. Each of the electrostatic latent images recorded on the photoconductive surface is developed with the appropriately colored toner and transferred, in superimposed registration with one another, to the sheet for forming the multi-color copy of the colored original document. One skilled in the art will appreciate that the sheet may move in a recirculating path for four cycles when undercolor black removal is used.

After the last transfer operation, the sheet transport system directs the sheet to a vacuum conveyor, indicated generally by the reference numeral 68. Vacuum conveyor 68 transports the sheet, in the direction of arrow 70, to a fusing station, indicated generally by the reference letter E, where the transferred toner image is permanently fused to the sheet. The fusing station includes a heated fuser roll 74 and a pressure roll 72. The sheet passes through the nip defined by fuser roll 74 and pressure roll 72. The toner image contacts fuser roll 74 so as to be affixed to the sheet. Thereafter, the sheet is advanced by a pair of rolls 76 to a catch tray 78 for subsequent removal therefrom by the machine operator.

The last processing station in the direction of movement of belt 20, as indicated by arrow 22, is a cleaning station, indicated generally by the reference letter F. A lamp 80 illuminates the surface of photoconductive belt 20 to remove any residual charge remaining thereon. Thereafter, a rotatably mounted fibrous brush 82 is positioned in the cleaning station and maintained in contact with photoconductive belt 20 to remove residual toner particles remaining from the transfer operation prior to the start of the next successive imaging cycle.

Figure 2:
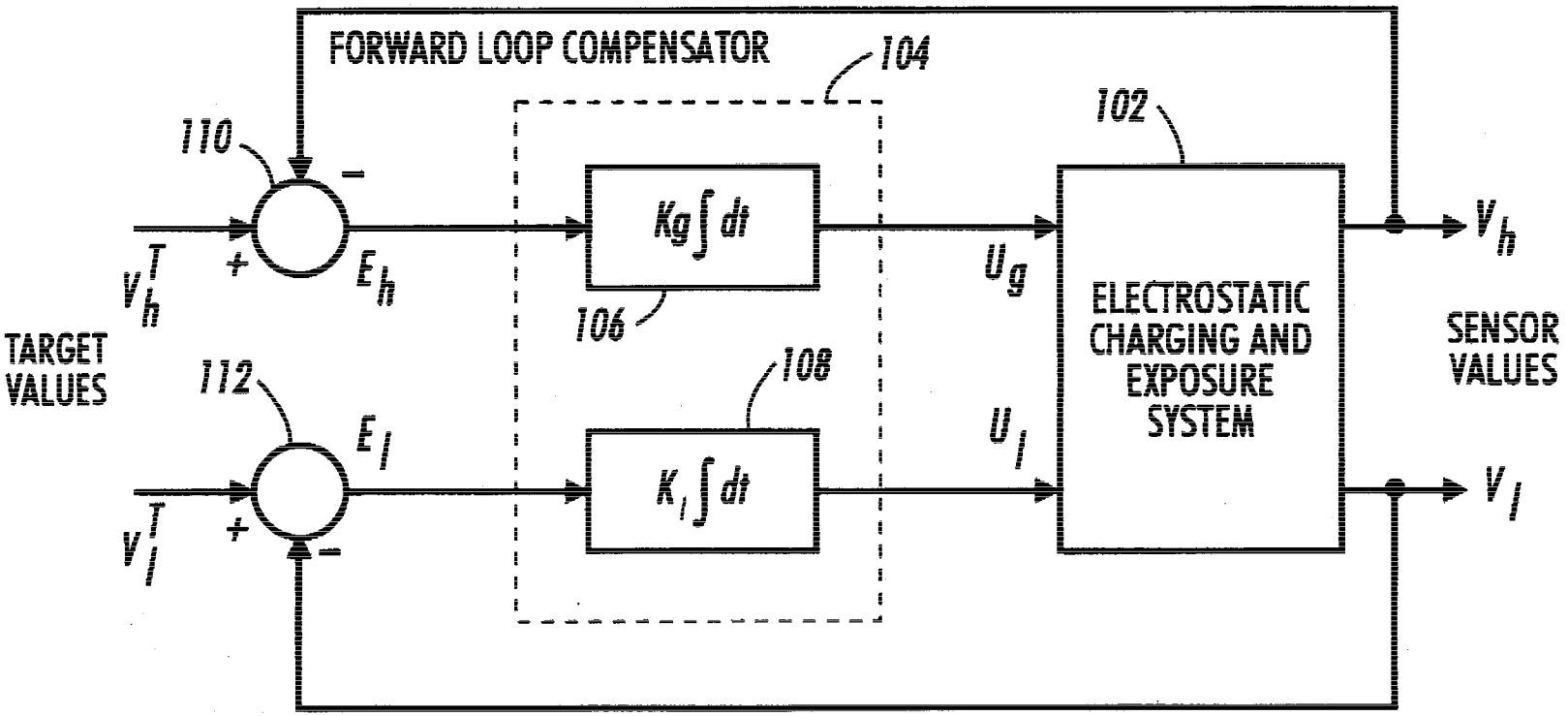
FIG. 2 (Prior Art)
FIG. 2 is a diagram of a typical prior art electrostatic feedback control system.

A diagrammatic representation of the system currently under practice for most xerographic print engines is shown in FIG. 2. Block 102 represents the charging and exposure systems. The block 104 representing compensators usually contains suitable integrators such as 106, 108 with some weighting. Here $v_h$ represents the voltage on the unexposed photoreceptor and $v_l$ represents the voltage after the exposure. $v_h^T$ and $v_l^T$ are the desired states for the voltages $v_h$ and $v_l$ and $E_h$ is the error generated by comparator 110 by subtracting the $v_h^T$ values with those measured by the ESV. Similarly, $E_l$ is the error generated by comparator 112 by subtracting the $v_l^T$ values with those measured by the ESV. $U_g$ and $U_l$ are the control signals to vary the grid voltage and laser power respectively.

Figure 3:
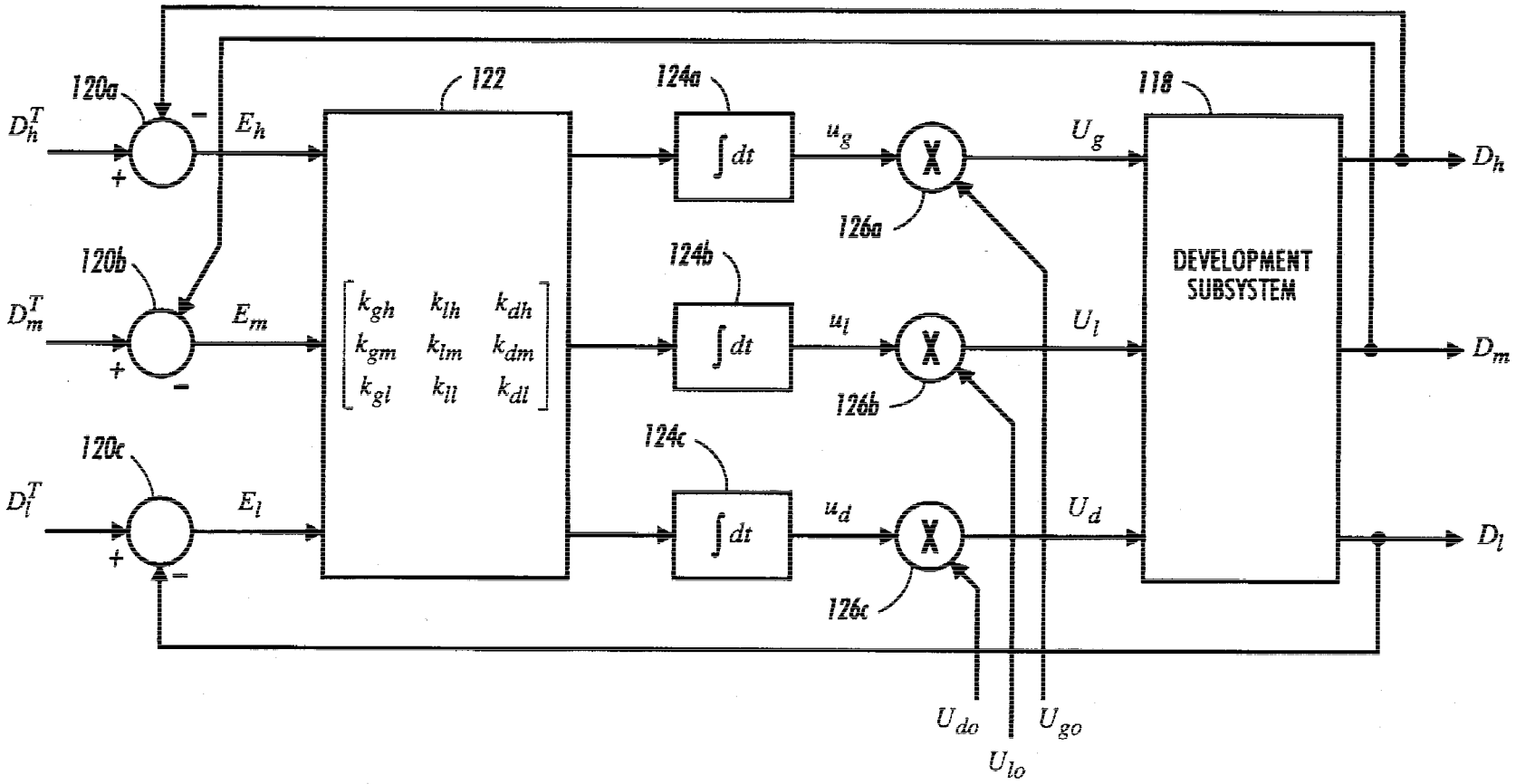
FIG. 3 illustrates a control loop architecture in accordance with the present invention.

With reference to FIG. 3, the control architecture in accordance with the present invention is described. Let $D_h$, $D_m$ and $D_l$ represent three different DMA measurements from development subsystem 118. These DMA measurements are basically identified as three different points on the tone reproduction curve and provide one input to summing nodes or comparators 120*a*, 120*b*, and 120*c* respectively. Let the corresponding target values to the control system be $D_h^T$, $D_m^T$ and $D_l^T$. These reference or target values are set by the user and provide another input to summing nodes or comparators 120*a*, 120*b*, and 120*c* respectively.

Comparators 120*a*, 120*b*, and 120*c* provide error signals $e_h$, $E_m$, and $E_l$ to adjustment matrix 122 in turn providing signals to integrators 124*a*, 124*b*, and 124*c* respectively. The output signals $u_g$, $u_l$ and $u_d$ of the integrators 124*a*, 124*b*, and 124*c* are input to summing nodes 126*a*, 126*b*, and 126*c*. The summing nodes also receive as input nominal set up values $U_{go}$, $U_{lo}$, and $U_{do}$ to provide actuator signals $U_g$, $U_l$ and $U_d$ to development subsystem 118 where $u_g$ represents the grid voltage on the charging system, $U_1$ represents the average beam power, and $U_d$ represents the donor voltage. These quantities are used directly at the actuator inputs.

A model for the system of the type described above is obtained as follows. If k is defined as any arbitrary print number, then following matrix equation can be written.

$$\underline{x}(k+1)=\underline{B}\underline{x}(k)+\underline{x}_o \quad (1)$$

where the vectors and matrices in equation 1 is given by $$\underline{x}(k)=\begin{bmatrix} D_h(k) \\ D_m(k) \\ D_l(k) \end{bmatrix}, \underline{x}_o=\begin{bmatrix} D_{ho} \\ D_{mo} \\ D_{lo} \end{bmatrix}, \underline{B}=\begin{bmatrix} B_{gh} & B_{ih} & B_{dh} \\ B_{gm} & B_{im} & B_{dm} \\ B_{gl} & B_{il} & B_{dl} \end{bmatrix} \quad (2)$$

The elements $D_{ho}$, $D_{mo}$ and $D_{lo}$ represent the DMA values for setup conditions when the control signals, $u_g$, $u_l$ and $u_d$ are zero. The matrix elements say, $B_{gh}$, $B_{gm}$ and $B_{gl}$ are the slopes of the $D_h$--$U_{go}$, $D_m$--$U_{go}$ and $D_l$--$U_{go}$ curves respectively when $U_l$ and $U_d$ are held at the setup conditions $U_{lo}$ and $U_{do}$ (i.e., when $u_l$ and $u_d$ are zero). Similarly, other elements of the $\underline{B}$ matrix are obtained from the measurement data of the printer once during setup. Gain matrix of FIG. 3 can be calculated by representing equation 1 in state space form. The state space equation for the feedback system shown in FIG. 3 can be written as:

$$\underline{x}(k+1)=\underline{A}\underline{x}(k)+\underline{B}\underline{u}(k) \quad (3)$$

$$\underline{y}(k)=\underline{C}\underline{x}(k)+\underline{F}\underline{r}(k) \quad (4)$$

$$\underline{u}(k)=\underline{K}\underline{y}(k) \quad (5)$$

In equations 3 and 4, the matrices, $\underline{A}=\underline{C}=-\underline{F}$ and are equal to a 3×3 identity matrices. Vectors $\underline{r}(k)$ and $\underline{y}(k)$ and the gain matrix, $\underline{K}$, are given by $$\underline{r}(k)=\begin{bmatrix} D_h^T \\ D_m^T \\ D_l^T \end{bmatrix}, \underline{y}(k)=\begin{bmatrix} -E_h(k) \\ -E_m(k) \\ -E_l(k) \end{bmatrix}, \underline{K}=\begin{bmatrix} k_{gh} & k_{ih} & k_{dh} \\ k_{gm} & k_{im} & k_{dm} \\ k_{gl} & k_{il} & k_{dl} \end{bmatrix} \quad (6)$$

Finally, the algorithm that is used in the controller to compute $u_g$, $u_l$ and $u_d$ is as follows.

$$u_g(k)=u_g(k-1)+k_{gh}E_h(k)+k_{ih}E_m(k)+k_{dh}E_l(k) \quad (7)$$

$$u_l(k)=u_l(k-1)+k_{gm}E_h(k)+k_{im}E_m(k)+k_{dm}E_l(k) \quad (8)$$

$$u_d(k)=u_d(k-1)+k_{gl}E_h(k)+k_{il}E_m(k)+k_{dl}E_l(k) \quad (9)$$

To have the DMA reach the setpoint one can calculate the gain matrix by inverting the $\underline{B}$ matrix so that the eigen values are placed at the origin. This will enable the control system to reach the setpoint in the next immediate print. Another way to calculate the gain matrix is by using pole placement algorithms.

Since the System is generally non-linear, the gain matrix can be computed at different points in the entire operating region of the printer. Generally three to four sets is regarded appropriate. Simulation curves can be shown for the following setup values.

$$U_{go}=600 \text{ Volts} \qquad D_h^T=0.58 \quad (10)$$

$$U_{lo}=0.2 \text{ milliwatts} \qquad D_m^T=0.4$$

$$U_{do}=100 \text{ Volts} \qquad D_l^T=0.12$$

The $\underline{B}$ and $\underline{K}$ matrices are given by $$\underline{B}=\begin{bmatrix} -0.0004 & 0.5302 & 0.0019 \\ -0.0013 & 0.8343 & 0.0022 \\ -0.0022 & 0.3300 & 0.0026 \end{bmatrix}, \quad (11)$$

-continued $$\underline{K}=1\times10^3\begin{bmatrix} 1.0523 & -0.5379 & -0.3311 \\ -0.001 & 0.0023 & -0.0012 \\ 1.0231 & -0.7496 & 0.2513 \end{bmatrix}$$

The control, in accordance with the present invention, has the following advantages.

The controller would require no electrostatic measurements. Hence cost of ESVs can be saved. The controller has the potential to reach the DMA targets with couple of prints, as long as the gains are designed to drive the system to stability. This is because of the integrator in the loop. This is same as saying the steady state error is independent of the matrix of the system whereas the overshoot depends upon the matrix. Hence, the gains would be scheduled at few operating points depending on the printer.

In addition, if this controller is implemented along with the feedforward lookup tables to generate nominal actuator values, then it is conceivable that dead beat control is possible to achieve. There are no system identification techniques required to estimate the electrostatic parameters.

While this invention has been described in conjunction with a specific apparatus, it is evident that many alternatives, modifications, and variations will be apparent to those skilled in the art. Accordingly, it is intended to embrace all such alternatives, modifications, and variations as fall within the spirit and broad scope of the appended claims.

I claim:

1. In an imaging system for projecting and developing images on an imaging member, a process control loop comprising;

a sensor to measure developed mass per unit area, the sensor measuring at least three test patches on the imaging member including high area coverage, low area coverage, and mid tone coverage, a control unit to process the error signals to actuate projecting, developing, and imaging member subsystems, the control including stored nominal actuator values, an integrator, and a compensator, the compensator responding to the integrator and nominal actuator values.

2. The process control loop of claim 1 wherein the projecting subsystem actuator is raster output scanner power.

3. The process control loop of claim 1 wherein the developing subsystem actuator is bias voltage.

4. The process control loop of claim 1 wherein the imaging member subsystem actuator is charting voltage.

5. The process control loop of claim 1 wherein high area coverage is approximately 90% to 100%, low area coverage is approximately 0 to 20% and mid tone area coverage is approximately 50%.

6. The process control loop of claim 1 wherein the control unit is a single multiple-input multiple-output controller.

7. An electrostatographic printing machine having an imaging member, a charging device for charging the imaging member, an image projecting device, and a developer device for apply toner to the imaging member, a control having control parameters comprising:

a sensor to sample developed toner mass per unit area on the imaging member and provide signals, a first actuator signal to enable the charging device, a second actuator signal to enable the developer device, a control responsive to the sensor signals to adjust both the first actuator signal to enable the charging device and the second actuator signal to enable the developer device, the control including stored nominal actuator values, an integrator, and a compensator, the compensator responding to the integrator and nominal actuator values.

8. The electrostatographic printing machine of claim 7 wherein the image projecting device is a raster output scanner and including a third actuator signal to enable the raster output scanner.

9. The electrostatographic printing machine of claim 8 wherein the integrator is responsive to the sensor signals to adjust the third actuator signal to enable the raster output scanner.

10. The electrostatographic printing machine of claim 7 wherein the control includes a gain matrix providing adjusted first and second actuator signals in response to sensor signals.

11. The electrostatographic printing machine of claim 10 wherein the gain matrix is defined by a mathematical expression.

12. The electrostatographic printing machine of claim 7 wherein the sensor measures low, medium, and high developed toner mass per unit area samples on the imaging member.

13. The electrostatographic printing machine of claim 7 wherein the compensator is a summing node.

14. An electrostatographic printing machine having an imaging member, a charging device for charging the imaging member, an image projecting device, and a developer device for apply toner to the imaging member, a control having control parameters comprising:

a sensor to sample developed toner mass per unit area on the imaging member and provide signals, a first actuator signal to enable the charging device, a second actuator signal to enable the developer device, a source of reference signals, a comparator responsive to the reference signals and the sensor signals to provide error signals, and a control including an integrator and summing node responsive to the error signals to adjust both the first actuator signal to enable the charging device and the second actuator signal to enable the developer device.

15. The electrostatographic printing machine of claim 14 wherein the image projecting device is a raster output scanner and including a third actuator signal to enable the raster output scanner.

16. The electrostatographic printing machine of claim 15 wherein the control is responsive to error signals to adjust the third actuator signal to enable the raster output scanner.

17. The electrostatographic printing machine of claim 14 wherein the control matrix is a gain matrix defining imaging member, image projecting device, and developer device interaction.

18. The electrostatographic printing machine of claim 14 wherein the sensor measures low, medium, and high developed toner mass per unit area samples on the imaging member.

19. The electrostatographic printing machine of claim 14 wherein the summing node is responsive to nominal actuator values.

* * * * *